US005441125A

United States Patent [19]

Cook

[11] Patent Number: 5,441,125

[45] Date of Patent: Aug. 15, 1995

[54] PLATFORM FOR TEMPORARY ATTACHMENT TO WALLS

[76] Inventor: William R. Cook, 6732 Lochdale Street, Burnaby, B.C., Canada, V5B 2N1

[21] Appl. No.: 91,292

[22] Filed: Jul. 15, 1993

[51] Int. Cl.[6] ..... E04G 3/08

[52] U.S. Cl. ..... 182/82; 52/73; 52/DIG. 12; 248/235

[58] Field of Search ..... 248/235, 236, 298; 182/82; 52/73, DIG. 12

[56] References Cited

U.S. PATENT DOCUMENTS

| | | | |
|---|---|---|---|
| 2,213,192 | 9/1940 | Kaufman | 52/73 |
| 3,017,155 | 1/1962 | Scarpetti | 248/235 |
| 3,026,963 | 3/1962 | Wilkie | 182/229 |
| 3,515,244 | 6/1970 | Weible | 182/150 |
| 3,552,522 | 1/1971 | Bobo | 182/82 |
| 4,090,585 | 5/1978 | Laub | 182/82 X |
| 4,421,205 | 12/1983 | Vranish | 182/82 |
| 4,898,355 | 2/1990 | Steinway | 248/248 X |
| 4,957,185 | 9/1990 | Courchesne et al. | 182/82 X |
| 5,052,648 | 10/1991 | Landau | 248/235 |
| 5,316,253 | 5/1994 | Flathau | 248/235 |

FOREIGN PATENT DOCUMENTS

| | | | |
|---|---|---|---|
| 2608872 | 9/1977 | Germany | 52/73 |

OTHER PUBLICATIONS

British Specification, 428,473, 1935, all figures.

*Primary Examiner*—Carl D. Friedman
*Assistant Examiner*—Beth A. Aubrey
*Attorney, Agent, or Firm*—Brian M. Long

[57] ABSTRACT

A platform support device for temporary attachment to a vertical side of a structure, e.g. for supporting planks on which a tradesman can stand while installing soffit, has an elongate upright member with an attachment portion at an upper end of the upright member. The attachment portion is formed with a flat face for abutment against the structure and with nail holes interrupting the flat face for receiving therethrough the heads of nails projecting from the structure, whereby the support can be suspended from the structure at a height determined by the locations of the nails. A pair of arms extending laterally outwardly from opposite sides of the upright member at a lower end of the upright member for stabilizing abutment against the structure. A horizontal support projects forwardly from the lower end of the upright member; and a reinforcement extends between and is fixed to the top of the support and the front of the upright member.

5 Claims, 4 Drawing Sheets

PLATFORM FOR TEMPORARY ATTACHMENT TO WALLS

BACKGROUND OF THE INVENTION

1. Field of the Invention

The present invention relates to platform for temporary attachment to a vertical side of a structure and is useful, in particular, for supporting planks from the side of a building under construction.

2. Description of the Related Art

During the construction of a wood-frame building, it is necessary to provide workmen with convenient access to the undersides of the eaves of the building to facilitate installation of the soffits.

The conventional scaffolding employed for this purpose may be inconvenient if the ground below the eaves is uneven or obstructed. The use of ladders is also inconvenient, and somewhat dangerous, due to the need for frequent relocation of the ladders and the risk of falling from the ladders.

It has previously been proposed, in U.S. Pat. No. 3,515,244, issued Jun. 2, 1970 to J. E. Weible, to provide a scaffolding device in a form of a tube or pipe having a transversely extending hanger member secured to an upper end thereof, so that the hanger member can be hooked over an upper edge of a partially completed wall or other building structure to suspend the scaffolding device. A support bracket is slightly disposed on the tube and can be adjusted in position on the tube by displacement of the support bracket up or down the tube and by the use of a pin inserted through the tube or pipe through any of a number of pairs of holes. The support bracket composes a horizontally outwardly extending arm, and a inclined brace located beneath the arm.

In use, a pair of such scaffolding devices are suspended from the top of a wall, and the support brackets are vertically adjusted along their tubes. Planks are then supported on the horizontally outwardly extending arms of the support brackets, to provide a platform on which a tradesman can stand.

This prior scaffolding device, however, has a disadvantage that it requires access to a horizontal member of a wall, for example the top plate of a frame wall, which may be in practice be impossible, for example in cases where such access is obstructed.

It is a further disadvantage of this prior device that, in order to selectively vary the height at which the planks are located, the support bracket must be adjustable in position along the length of the tube or pipe. Consequently, either a very long tube or pipe must be provided, in order to provide a wide range of height adjustment, or alternatively a number of tubes or pipes of different lengths must be provided. In either case, the expense of manufacture, storing and transportation of the scaffolding device is correspondingly increased.

BRIEF SUMMARY OF THE INVENTION

It is, accordingly, an object of the present invention to provide a novel and improved support device for temporary attachment to a structure e.g. a partially or completely constructed wall, which device can be secured at any desired height on the structure, without access to the top of the structure, and which is also compact.

According to the present invention, a platform for temporary attachment to a vertical side of a structure, comprises an elongate upright member with an attachment portion at an upper end of the upright member. The attachment portion is formed with a flat face for abutment against the structure and with at least one opening interrupting the flat face for receiving therethrough a projection extending from the structure, whereby the support can be suspended from the structure at a height determined by the locations of the projection. A pair of arms extending laterally outwardly from opposite sides of the upright member at a lower end of the upright member for stabilizing abutment against the structure. A horizontal support projects forwardly from the lower end of the upright member; and a reinforcement extends between and is fixed to the top of the support and the front of the upright member.

In use, the horizontal support is used to support planks, and it is a particular advantage of the present support device that the height at which the planks are supported on the structure is not determined by the dimensions of the support device itself, nor by the location of a top or other horizontal part of the structure, but rather by the position of the projection, which may take the form of one or more nails. Consequently, since the user of the present support device can himself select the location at which he wishes to insert the nails into the vertical structure, he can readily select and vary the height of the planks according to his requirements.

Since the height at which the planks are located is not determined by the dimensions of the present support device, the latter can be designed with a compact structure, and in particular with a relatively short dimension for the upright member.

BRIEF DESCRIPTION OF THE DRAWINGS

Further objects, features and advantages of the present invention will be more readily apparent from the following description of a preferred embodiment thereof, when taken in conjunction with the accompanying drawings, in which.

THE PREFERRED EMBODIMENT

Figure 1:
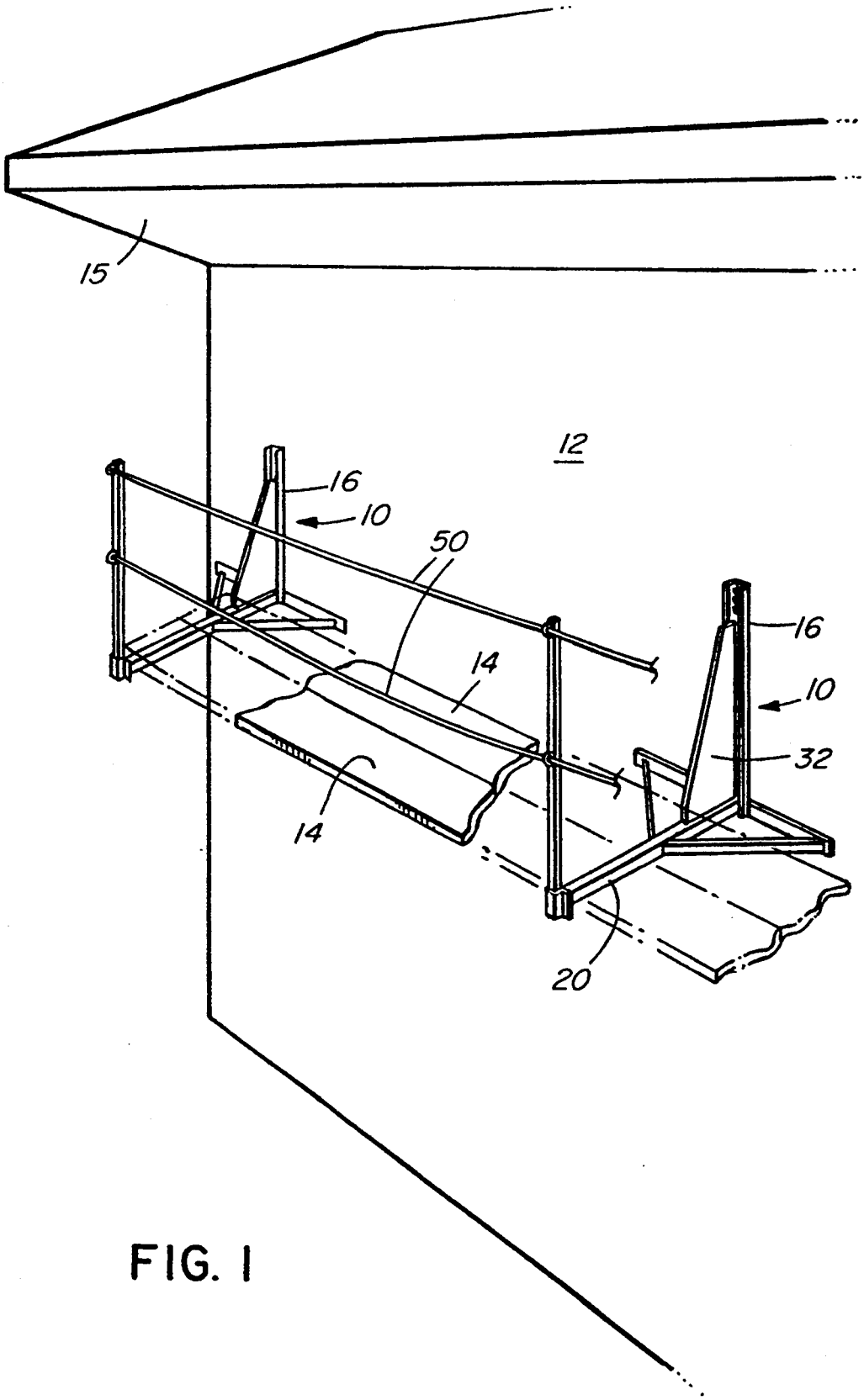
FIG. 1 shows a view in perspective of a pair of support devices temporarily attached to a wall of a building under construction.

Referring now to FIG. 1, there is shown a platform comprising a pair of horizontally-spaced support devices, indicated generally by reference numerals 10 which are temporarily attached, as described in greater detail, to a wall 12 of a building under construction, and a pair of planks 14.

The planks 14, which for convenience of illustration are shown partially broken away and partially in chain-dot lines, are supported side-by-side on the support devices 10, so as to provide a platform on which a tradesman can stand while working on the building and, more particularly, while installing a soffit under the eaves 15 of the building.

Figure 2:
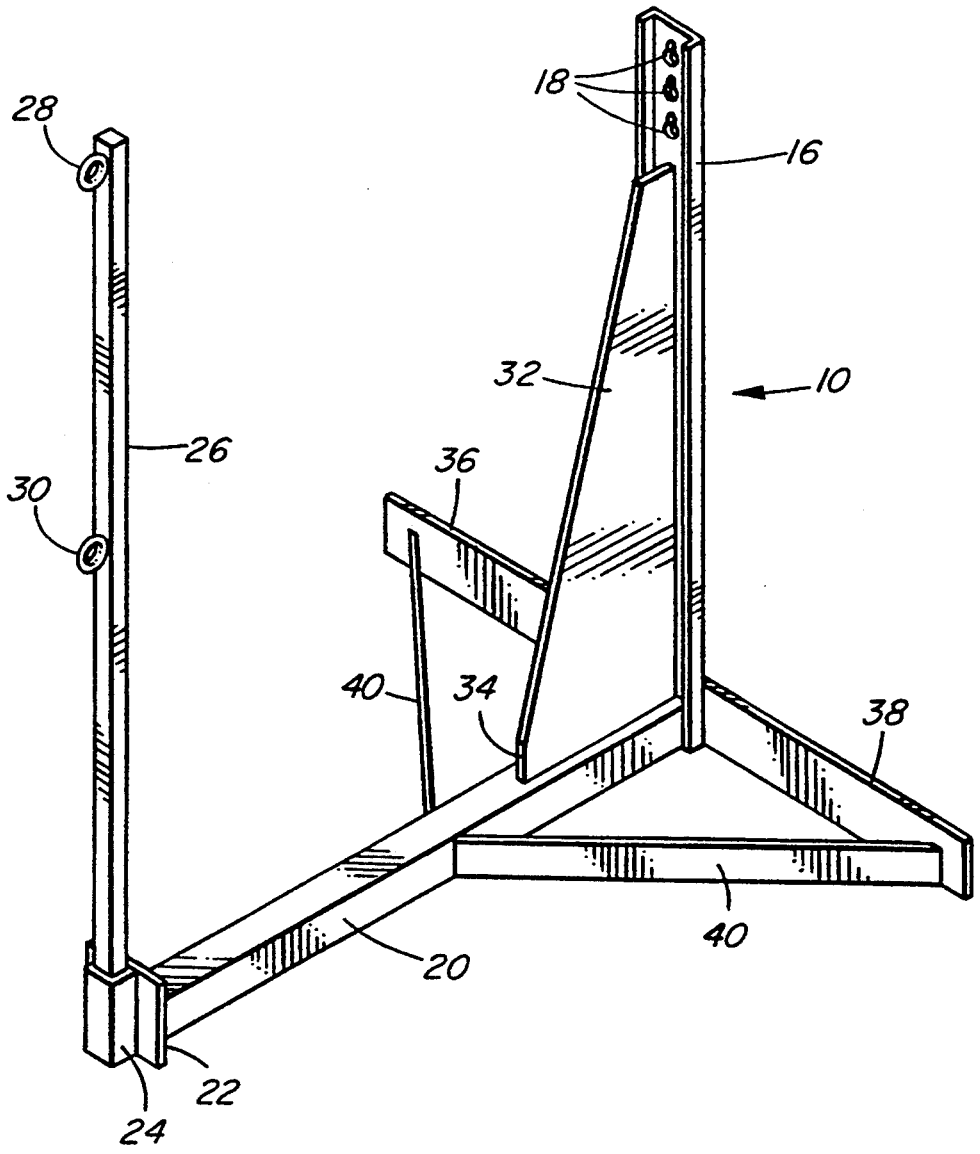
FIG. 2 shows a view in perspective of one of the support devices of FIG. 1.

Turning now to FIG. 2, the support device 10 illustrated therein has, at its rear, an upright member 16, which is formed of U-shaped metal channel.

The upper end of the upright 16 is formed with a vertical row of three keyhole-shaped openings 18 for receiving the heads of nails, as described in greater detail below.

A horizontal arm or support member 20, of hollow square-section metal, projects forwardly from the lower end of the upright member 16 and, at its forward free end remote from the upright member 16, is welded to a rectangular, vertical plate 22, which in turn is welded to an upwardly-open, square-section post socket 24.

A post 26, of solid, square cross-section metal, has its lower end inserted into and supported by the socket 24, and is provided, at its top and approximately mid-way along its length, with a pair of vertically-oriented metal rings 28 and 30, which are welded to the post 26.

A reinforcement plate 32 is welded to the front of the upright member 16 and to the top of the horizontal support 20. At its lower end, the reinforcement plate 32 is formed with a vertical abutment edge 34 at its front edge, i.e. at its edge remote from the upright member 16. The abutment edge 34 and the plate 22, which serves as a counter-abutment, abut respective edges of the planks 14 so as to locate the planks 14 in position. Consequently, it is not possible for the planks 14 to slide horizontally along the support 20 and apart from one another, so as to form a dangerous gap between the planks 14.

A pair of arms 36 and 38 extend laterally outwardly from opposite sides of the upright member 16, at the lower end of the upright member 16. The arms 36 and 38 are formed in one piece of metal strip, and are welded to the rear face of the upright member 16. The arms 36 and 38 are reinforced by a pair of horizontally extending, metal strip braces 40, which are welded to the arms 36 and 38, respectively, and to the support 20. The braces 40 may be replaced by channel-shaped braces (not shown) having a height dimension less than that of the support 20 and with their upper edges below the level of the top of the support 20 so as to facilitate the positioning of the planks 14. Three triangular spikes 39 project rearwardly from the metal strip forming the arms 36 and 38.

Figure 3:
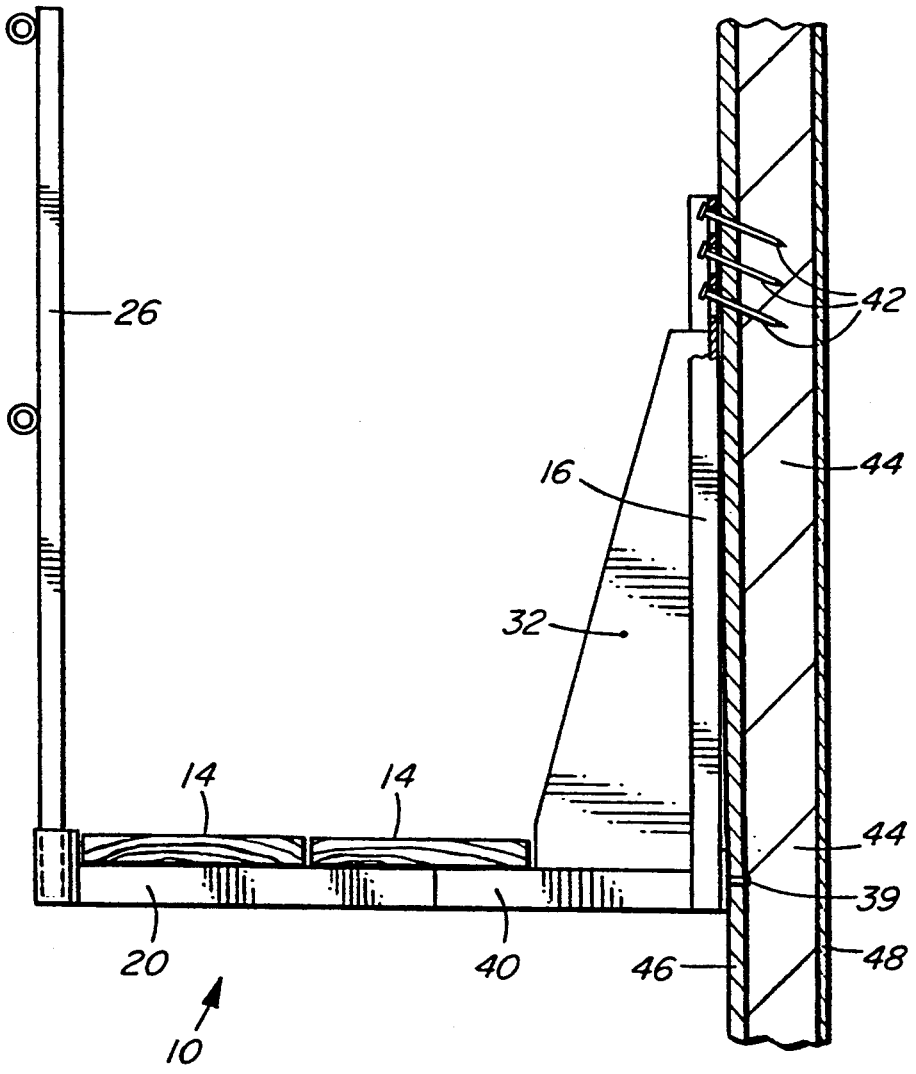
FIGS. 3, 4 and 5 show views taken inside elevation, overhead plan and rear elevation, respectively, of the support device of FIG. 2.
Figure 4:
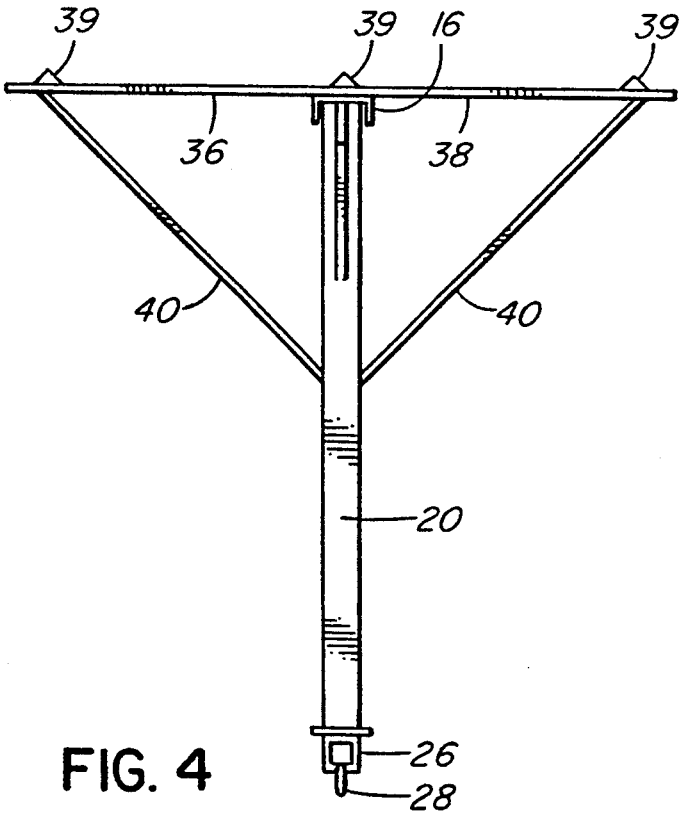
Figure 5:
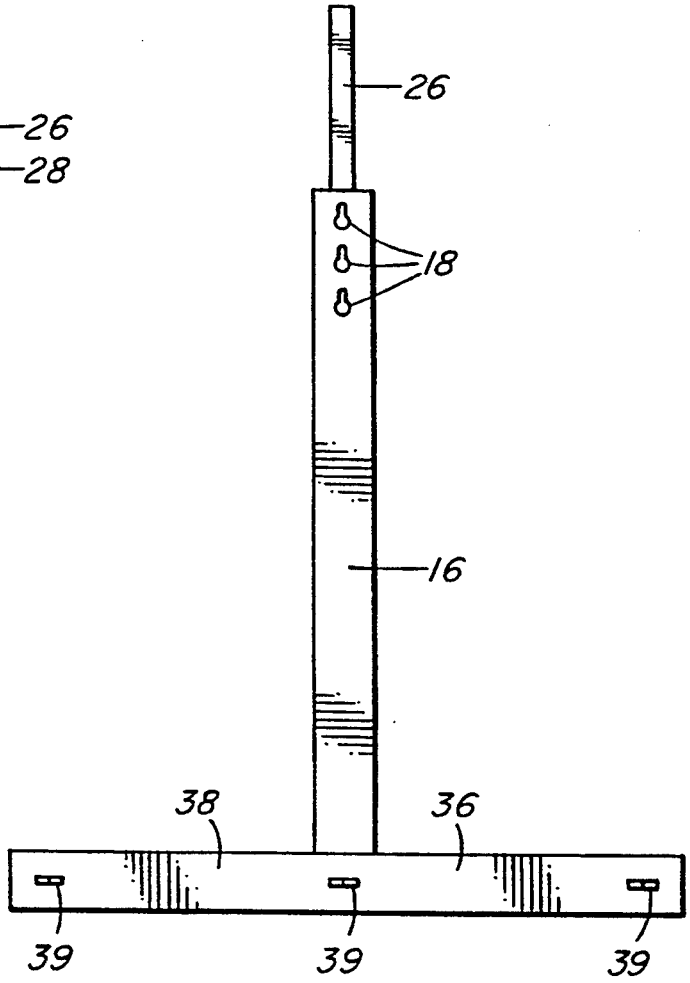

When the above-described support device is in use, the user firstly inserts three nails 42 into a wall structure, for example into a stud 44, which as shown on FIG. 3 as provided at its outside with a siding 46 and at its inner side with drywall 48.

The nails 42 may be inserted into the stud 44 by hammering them through the keyhole-shaped openings 18 in the upright member 16, or they may be hammered into the stud 44 before the support device 10 is brought into position. In the latter case, the support device 10 is then suitably manipulated so as to cause the projecting heads of the nails 42 to pass through the openings 18.

With at least two of the support devices 10 thus suspended from the wall, at a desired height and at a horizontal spacing from one another, as shown in FIG. 1, the planks 14 may be laid over the horizontal supports 20. The spacing between the abutment edge 34 on the reinforcement 32 and the counter-abutment formed by the plate 22 is selected so as to be just slightly greater than the widths of the two planks 14, so that the latter are located and retained in close lateral juxtaposition.

Each of the support devices 10 these has its post 26 inserted into its socket 24, and a pair of safety ropes 50 are secured to the posts 26, by means of the rings 28 and 30.

The metal spikes 39 at the rear sides of the support devices are pressed into the siding 46, and serve to stabilize the support devices 10 against lateral movement across the outer face of the siding 46 and, thus, relative to the wall 12.

Various modifications may be made to the above-described embodiment of the invention within the scope of the appended claims.

For example, instead of employing nails, as described above, to suspend the support device, it is alternatively possible to use some other type of anchoring projection extending from the wall to engage in and support the upright member. Such a projection may, for example, take the form of a pin or the like, which may be permanently embedded at one end in a wall. This arrangement may be useful to enable the support device to be employed by window washers.

I claim:

1. A platform for temporary attachment to projections extending from a vertical side of a structure, comprising:

a pair of support devices for attachment to the projections; and a pair of planks;

said support devices each comprising:

an elongate upright member;

said elongate upright member having an upper end and a lower end, a lower end opposite sides and a front;

an attachment portion at said upper end;

said attachment portion having an opening for receiving one of the projections therethrough, whereby said elongate upright member is suspended from the structure at a location determined by the location of the respective projections;

a pair of arms extending laterally outwardly from the opposite sides of said lower end of said elongate upright member for stabilizing abutment against the structure;

an elongate horizontal support projecting forwardly from said lower end of said elongate upright member for supporting said planks thereon;

said support having one end attach to said elongate upright member, a free end spaced from said upright member and a top for supporting said planks thereon; and a reinforcement extending between and jointed to said top of said support and said front of said elongate upright member.

2. A platform as claimed in claim 1, further comprising a post upstanding from said free of said support.

3. A platform as claimed in claim 2, further comprising means at said free for releasably connecting said post to said support.

4. A platform as claimed in claim 3, wherein said means for connecting comprise a socket for receiving said post.

5. A platform as claimed in claim 1, wherein said reinforcement has a lower and upper, the lower end end spaced from said upright member and forming an abutment on said support and wherein a counter-abutment is provided on said support at said other end, said abutment and said counter-abutment being spaced apart for abutment against said planks for retaining said planks in position on said support.

* * * * *